United States Patent [19]

Hintzen et al.

[11] Patent Number: 5,025,961

[45] Date of Patent: Jun. 25, 1991

[54] REFRACTORY SHUTOFF ASSEMBLY CAPABLE OF IMPROVED EMERGENCY CLOSING

[75] Inventors: Ullrich Hintzen, Taunusstein-Watzhahn; Ernst Lührsen, Bad Schwalbach; Andreas Schuler, Taunusstein, all of Fed. Rep. of Germany

[73] Assignee: Didier-Werke AG, Wiesbaden, Fed. Rep. of Germany

[21] Appl. No.: 567,012

[22] Filed: Aug. 13, 1990

[30] Foreign Application Priority Data

Aug. 12, 1989 [DE] Fed. Rep. of Germany ..... 3926678

[51] Int. Cl.[5] ..... B22D 41/14

[52] U.S. Cl. ..... 222/599; 222/598

[58] Field of Search ..... 164/337, 335, 437; 222/598, 602, 594, 597, 599; 266/236

[56] References Cited

U.S. PATENT DOCUMENTS

| | | | |
|---|---|---|---|
| 1,585,002 | 5/1926 | Williams | 222/597 |
| 3,374,930 | 3/1968 | Hase et al. | 222/591 |

FOREIGN PATENT DOCUMENTS

| | | | |
|---|---|---|---|
| 3540202 | 11/1986 | Fed. Rep. of Germany . | |
| 63-264255 | 11/1988 | Japan | 164/337 |
| 493296 | 2/1976 | U.S.S.R. | 222/594 |
| 846071 | 7/1981 | U.S.S.R. | 164/337 |
| 1311847 | 5/1987 | U.S.S.R. | 164/337 |

*Primary Examiner*—J. Reed Batten, Jr.

*Attorney, Agent, or Firm*—Wenderoth, Lind & Ponack

[57] ABSTRACT

A refractory shutoff assembly for controlling the discharge of molten metal from a metallurgical vessel includes a refractory inner pipe to be fixedly mounted in a bottom of the vessel, such inner pipe having therethrough at least one opening at a position to be above the vessel bottom. A refractory outer pipe is mounted about the inner pipe and has therethrough at least one opening. The outer pipe has a lower end with an annular end surface. The outer pipe is movable relative to the inner pipe axially thereof between an open position, whereat the opening in the outer pipe aligns with the opening in the inner pipe, and a closed position, whereat such openings are isolated to block molten metal discharge. The length of possible axial movement of the outer pipe relative to the inner pipe from the open position is sufficient to enable movement of the outer pipe to another closed position, whereat the openings are isolated from each other and whereat the annular end surface sealingly abuts on an annular surface extending around the inner pipe, thereby entirely enclosing the inner pipe.

9 Claims, 2 Drawing Sheets

REFRACTORY SHUTOFF ASSEMBLY CAPABLE OF IMPROVED EMERGENCY CLOSING

BACKGROUND OF THE INVENTION

The present invention relates to a refractory shutoff assembly for use in controlling, regulating and interrupting the discharge of molten metal from a metallurgical vessel. More particularly, the present invention relates to such a refractory shutoff assembly including a refractory inner pipe or stator to be fixedly mounted in a bottom of the metallurgical vessel, such inner pipe having therethrough at least one transverse opening at a position to be above the vessel bottom when the inner pipe is fixedly mounted therein. The assembly further includes a refractory outer pipe or rotor to be mounted about the inner pipe, the outer pipe having therethrough at least one transverse opening, and the outer pipe having a lower end. The outer pipe is movable relative to the inner pipe axially thereof between an open position, whereat the at least one opening in the outer pipe aligns with the at least one opening in the inner pipe, and a closed position whereat the at least one opening in the inner pipe is isolated from the at least one opening in the outer pipe. The outer pipe also may be rotatably movable relative to the inner pipe to move the outer pipe between open and closed positions.

Such a refractory shutoff assembly is disclosed in German DE 35 40 202. In such reference, to control the discharge of molten metal, an outer pipe can be rotated and moved axially relative to a fixed inner pipe. When the outer pipe is in a closed position, the openings through the two pipes are out of alignment so that molten metal discharge is interrupted.

However, such known arrangement suffers from an inherent disadvantage. Particularly, when the outer pipe is displaced axially by its maximum closing stroke relative to the inner pipe to a closed position, there remains a space between the lower end of the outer pipe and the bottom of the vessel. In such space the outer surface of the inner pipe is totally exposed to the molten metal within the metallurgical vessel. Thus, any cracks that may exist in the inner pipe are not covered by the outer pipe. Accordingly, a molten metal break through such cracks is possible. Additionally, in operation of such known device, in the event of a maximum displacement of the outer pipe in the axial direction to a closed position, the outer pipe makes contact with the upper end of the inner pipe that is positioned within the outer pipe. As a result, the upper end of the inner pipe is subjected to mechanical stresses which increases the likelihood of formation of cracks in the inner pipe and thereby the risk of molten metal breakthrough. Consequently, the refractory shutoff assembly disclosed in such German reference does not provide for operationally adequate emergency closing of the assembly.

SUMMARY OF THE INVENTION

With the above discussion in mind, it is an object of the present invention to provide an improved refractory shutoff assembly of the above described type, but whereby it is possible to overcome the above and other prior art disadvantages.

It is a further object of the present invention to provide such a refractory shutoff assembly capable of improved emergency closing.

It is a yet further object of the present invention to provide such an improved refractory shutoff assembly capable of more surely preventing molten metal breakthrough in the event of cracking or other damage of parts of the assembly.

The above objects are achieved in accordance with the present invention by the provision that the outer pipe is designed to have a length of possible axial movement relative to the inner pipe from the open position sufficient to enable movement of the outer pipe to another closed position, whereat the at least one opening in the inner pipe also is isolated from the at least one opening in the outer pipe and whereat the annular end surface of the outer pipe is sealingly abutted with or seated on an annular surface extending around the inner pipe. As a result of this structural feature of the present invention, when it is necessary to quickly close the shutoff assembly, for example during an emergency wherein there is concern for the potential of molten metal breakthrough, such as when the inner pipe has become stressed or cracked, then the outer pipe is rapidly movable to a position closing the openings in the pipes and sealingly seating the annular end surface of the outer pipe on the annular surface that extends around the inner pipe. During normal operation, i.e. in the absence of an emergency situation, the outer pipe is moved as is conventional in the prior art. However, if necessary to prevent a molten metal breakthrough, the capability of a rapid emergency closing movement of the outer pipe quickly displaces the outer pipe axially until the annular end surface thereof strikes against the annular surface surrounding the inner pipe. Preferably, in such emergency sealing position the outer pipe entirely encloses that portion of the inner pipe extending inwardly of the vessel bottom. The abutment of the annular end surface of the outer pipe with the annular surface extending around the inner pipe provides an additional seal.

In a preferred arrangement of the invention, the annular surface extending around the inner pipe lies in the plane of the bottom of the vessel. This guarantees the feature that, in the event of an emergency closing operation, the portion of the inner pipe projecting into the vessel is entirely enclosed by the outer pipe and entirely isolated from the molten metal within the vessel.

Preferably the annular surface extending around the inner pipe is formed by the vessel bottom itself. However, it also is possible to form such annular surface as an exterior step of the inner pipe.

In accordance with a further feature of the present invention, the outer pipe is of a sturdier construction than the inner pipe. Also, the inner pipe has a closed and curved upper end, and the outer pipe has therein a transverse portion closing the interior of the outer pipe and curved in a manner complementary to the curved upper end of the inner pipe. The distances between the curved transverse portion and the annular end surface of the outer pipe and between the curved upper end of the inner pipe and the annular surface extending around the inner pipe are such that, upon rapid emergency movement of the outer pipe to the another closed position relative to the inner pipe, the outer pipe compresses the inner pipe. Thereby it is possible to compress any cracks that may have formed in the inner pipe. Alternatively by this arrangement, it is possible for such distances to be such that the rapid emergency closing movement of the outer pipe causes partial destruction of the inner pipe, thereby causing clogging of the axial discharge outlet through the inner pipe. In such an arrangement, it of course must be borne in mind that the outer pipe is undamaged and totally encloses the inner pipe. Of course thereafter the inner pipe would have to be replaced.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
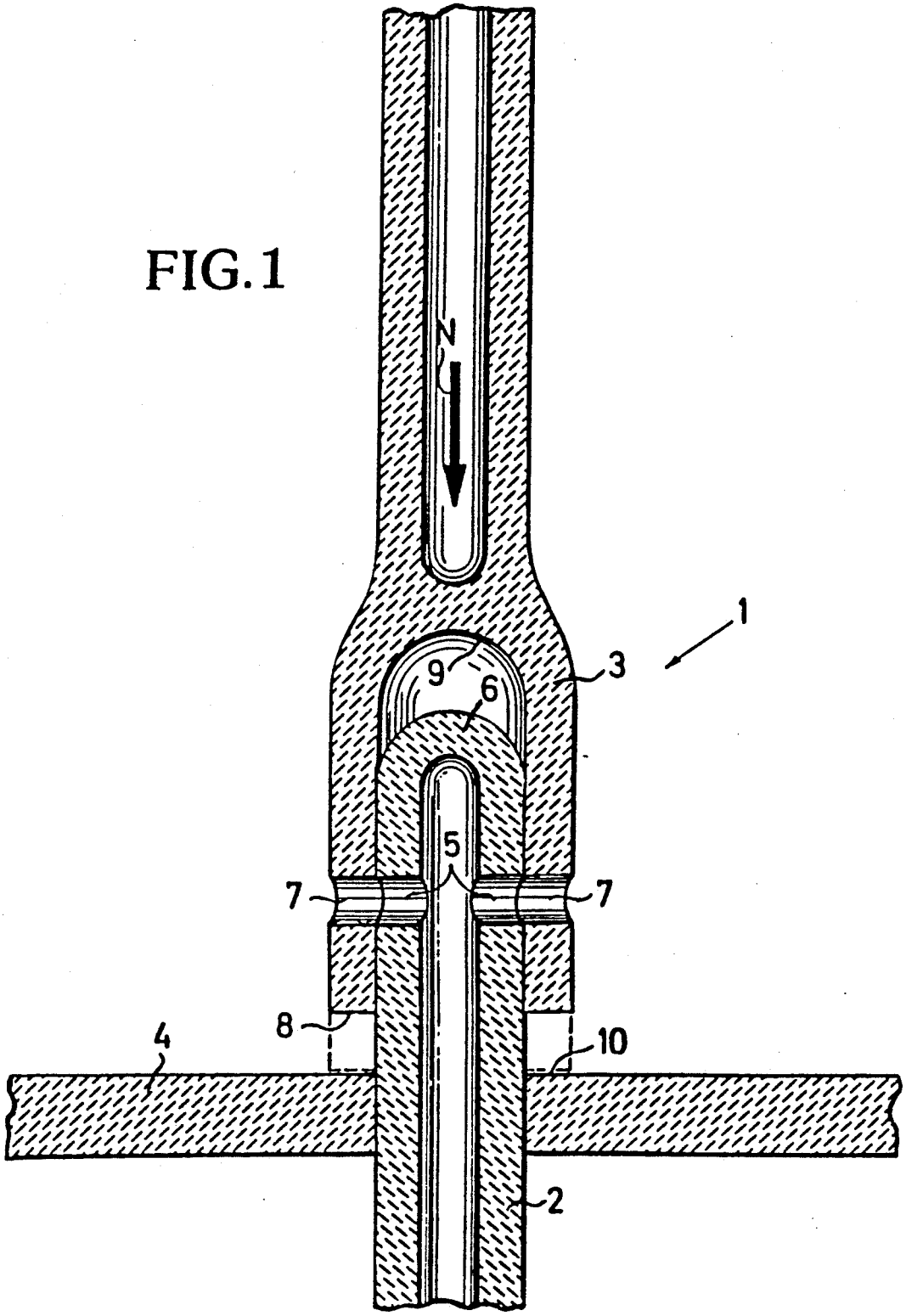
FIG. 1 is a longitudinal sectional view of one embodiment of a refractory shutoff assembly in accordance with the present invention.

Illustrated in the drawings are embodiments of a refractory shutoff assembly 1 for controlling the discharge of molten metal from a metallurgical vessel. A bottom 4 of the metallurgical vessel is illustrated. The assembly 1 includes a refractory inner pipe or tubular stator 2 mortared or cemented in an air tight and molten metal tight manner within the bottom 4 of the vessel. An inner or upper portion of pipe 2 extends upwardly into the interior of the vessel. The longitudinal axis of pipe 2 extends vertically or perpendicularly to vessel bottom 4. Above bottom 4 within the interior of the vessel the inner pipe 2 is provided with at least one opening 5, for example plural transverse openings as illustrated. The upper or inner end 6 of inner pipe 2 is closed.

The assembly 1 also includes a refractory outer pipe or tubular rotor 3 mounted about inner pipe 2 and within the interior of the vessel. The outer pipe has therethrough at least one opening 7, for example transverse openings as illustrated. Outer pipe 3 has a lower end with an annular end surface 8.

Outer pipe 3 is movable relative to inner pipe 2 at least axially, and preferably also rotatably in a conventional manner, between closed and open positions. The open position is illustrated in the drawings and at such position the openings 7 of outer pipe 3 are aligned with the openings 5 in the inner pipe 2. Thus, molten metal is free to pass through openings 7, 5 and downwardly through an axial discharge passage in inner pipe 2. Upon axial or rotatable movement of outer pipe 3 relative to inner pipe 2 to a closed position, the openings 5 are isolated from openings 7, and thereby the molten metal is blocked from discharge through inner pipe 2. Such relative movement also may be employed in a conventional manner to regulate the relative degree of open communication between openings 5 and 7.

Figure 2:
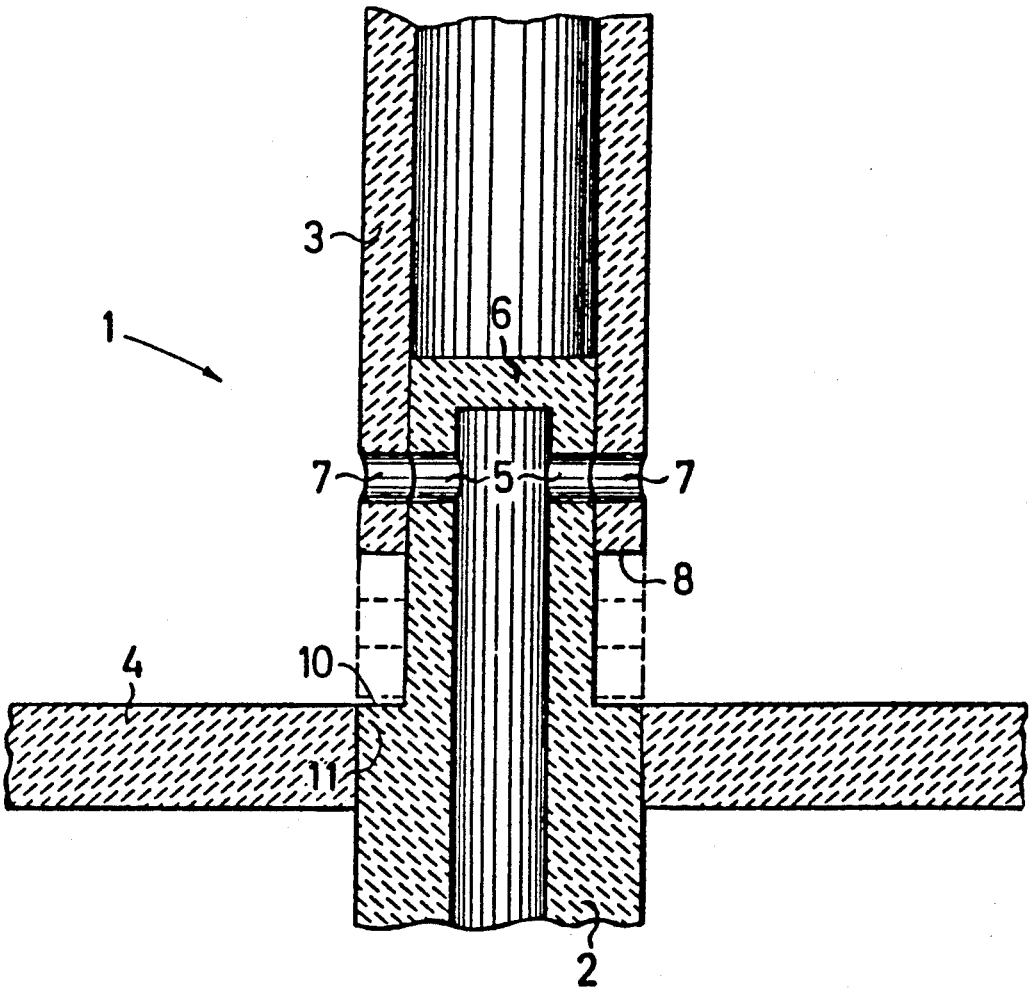
FIG. 2 is a similar view of another embodiment thereof.

If it is necessary to achieve an emergency closing of the assembly 1, for example if there is an indication of a potential molten metal breakthrough, then outer pipe 3 is displaced, for example in a single rapid movement, in the direction of arrow N until annular end surface 8 strikes against and contacts, for example in a sealing manner, an annular surface 10 that extends around inner pipe 2. In the embodiment of FIG. 1, annular surface 10 is formed by vessel bottom 4 in the vicinity of inner pipe 2. In the embodiment of FIG. 2, annular surface 10 is formed by a step 11 of inner pipe 2. In both illustrated embodiments there is shown a preferred feature of the present invention wherein annular surface 10 extends in the plane of vessel bottom 4. Such emergency closing operation isolates openings 7 from openings 5 and entirely encloses the portion of inner pipe 2 within the interior of the vessel. Thus, it is guaranteed at this stage that no additional molten metal will be discharged, even if inner pipe 2 has cracks or has been damaged. The position of the lower end of outer pipe 3 at this emergency closing position (i.e. the "another closing position" referred to herein) is illustrated by dashed lines in the drawings.

The dimensioning of inner pipe 2 in the region of openings 5 is such that inner pipe 2 is weaker than outer pipe 3. In the embodiment of FIG. 2, the dimensioning of inner pipe 2 is such that inner pipe 2 is stronger below step 11 than above step 11.

In the embodiment of FIG. 1 the closed inner end 6 of inner pipe 2 is curved, and the outer pipe 3 has therein a transverse partition or portion that has a curvature 9 complementary to the curvature of upper end 6 of inner pipe 2. Since the design in construction of outer pipe 3 is more stable and sturdy than that of inner pipe 2, it is possible to provide an arrangement whereby upon a rapid closing axial movement of outer pipe 3, the curvature 9 acts on curved end 6 to compress any cracks that may have formed in inner pipe 2. For example, this may be achieved by appropriate dimensioning of the distance between surface 9 and surface 8 and the distance between curved upper end 6 and surface 10. Furthermore, it is possible to dimension such distances such that curved portion 9 actually results in partial destruction of inner pipe 2, thereby perhaps providing additional blockage of the axial discharge passage extending through inner pipe 2. It of course is apparent that in such emergency closed position outer pipe 3 entirely surrounds inner pipe 2. Furthermore, it of course will be apparent that after any such action, subsequent usage of the inner pipe 2 would not be possible, and inner pipe 2 would have to be replaced.

Although the present invention has been described and illustrated with respect to preferred features, it is to be understood that various changes and modifications may be made to the specifically described and illustrated features without departing from the scope of the present invention.

WE CLAIM:

1. A refractory shutoff assembly for controlling the discharge of molten metal from a metallurgical vessel, said assembly comprising:

a refractory inner pipe to be fixedly mounted in a bottom of the metallurgical vessel, said inner pipe having therethrough at least one opening at a position to be above the vessel bottom when said inner pipe is fixedly mounted therein;

a refractory outer pipe to be mounted about said inner pipe, said outer pipe having therethrough at least one opening, and said outer pipe having a lower end with an annular end surface;

said outer pipe being movable relative to said inner pipe axially thereof between an open position, whereat said at least one opening in said outer pipe aligns with said at least one opening in said inner pipe, and a closed position, whereat said at least one opening in said inner pipe is isolated from said at least one opening in said outer pipe; and the length of possible axial movement of said outer pipe relative to said inner pipe from said open position being sufficient to enable movement of said outer pipe to another closed position, whereat said at least one opening in said inner pipe also is isolated from said at least one opening in said outer pipe and whereat said annular end surface is to be sealingly seated on an annular surface to extend around said inner pipe.

2. An assembly as claimed in claim 1, wherein when said outer pipe is in said another closed position said outer pipe covers the entire outer surface of said inner pipe above the vessel bottom.

3. An assembly as claimed in claim 1, further comprising said annular surface extending in a plane to be coplanar with the plane of the vessel bottom.

4. An assembly as claimed in claim 1, wherein said annular surface is formed on the vessel bottom.

5. An assembly as claimed in claim 1, wherein said annular surface is formed by a step of said inner pipe.

6. An assembly as claimed in claim 1, wherein said outer pipe is of a sturdier construction than said inner pipe.

7. An assembly as claimed in claim 1, wherein said inner pipe has a closed and curved upper end.

8. An assembly as claimed in claim 7, wherein said outer pipe has therein a transverse portion curved complementary to said curved upper end of said inner pipe.

9. An assembly as claimed in claim 8, wherein the distance between said curved transverse portion and said annular end surface of said outer pipe and the distance between said curved upper end of said inner pipe and said annular surface are such that, upon a rapid emergency movement of said outer pipe to said another closed position relative to said inner pipe, said outer pipe compresses said inner pipe.

* * * * *